US012740604B2

(12) United States Patent
Zhu et al.

(10) Patent No.: US 12,740,604 B2
(45) Date of Patent: Sep. 22, 2026

(54) SPORTSWEAR AND BODY-PROTECTING GEARS INCORPORATING SHEAR-THICKENING OR NON-NEWTONIAN FOAMS

(71) Applicant: Super Rich Moulders Limited, Hong Kong (HK)

(72) Inventors: Yong Zhu, Hong Kong (HK); Jianping Han, Hong Kong (HK); Hin Kiu Lee, Hong Kong (HK); Chenmin Liu, Hong Kong (HK); Sui Lung Cheung, Hong Kong (HK); Man Shan Cheung, Hong Kong (HK)

(73) Assignee: Super Rich Moulders Limited, Hong Kong (HK)

( * ) Notice: Subject to any disclaimer, the term of this patent is extended or adjusted under 35 U.S.C. 154(b) by 0 days.

(21) Appl. No.: 18/715,099

(22) PCT Filed: Feb. 6, 2023

(86) PCT No.: PCT/CN2023/074541

§ 371 (c)(1),
(2) Date: May 30, 2024

(87) PCT Pub. No.: WO2023/151530

PCT Pub. Date: Aug. 17, 2023

(65) Prior Publication Data

US 2025/0040626 A1 Feb. 6, 2025

Related U.S. Application Data

(60) Provisional application No. 63/355,664, filed on Jun. 27, 2022, provisional application No. 63/308,479, filed on Feb. 9, 2022.

(51) Int. Cl.
*A41C 3/00* (2006.01)
*A41D 13/05* (2006.01)

(52) U.S. Cl.
CPC ..... *A41C 3/0057* (2013.01); *A41D 13/05* (2013.01); *A41D 2500/50* (2013.01)

(58) Field of Classification Search
None
See application file for complete search history.

(56) References Cited

U.S. PATENT DOCUMENTS 6,701,529 B1 * 3/2004 Rhoades ..... C08L 83/16 2/2.5
7,731,564 B2 6/2010 Sanders
(Continued)

FOREIGN PATENT DOCUMENTS

CN 2378955 Y 5/2000
CN 103798978 A 5/2014
(Continued)

OTHER PUBLICATIONS

Jie Zhou et al., "Identifying effective design features of commercial sports bras.", Textile Research Journal, 2013, DOI: 10.1177/0040517512464289.
(Continued)

*Primary Examiner* — Jocelyn Bravo
(74) *Attorney, Agent, or Firm* — IDEA Intellectual Limited; Sam T. Yip

(57) ABSTRACT

A sports bra exhibits increased resistance in response to increased force. The sports bra includes a front curved region for accommodating a wearer's breasts, the front curved region including a shear-thickening foam. The shear-thickening foam is relatively flexible up to a first force and is relatively rigid above the first force to retain the wearer's breasts within the front curved region during vigorous physical activity. A back panel connecting to the front curved region such that the force is at least partially transferred to an upper back or shoulder region of the wearer. A body protecting element protects a body part from an
(Continued)

external impact, the body part selected from head, knee, shin, elbow, foot, leg, torso, arm, wrist or hand. The body protecting element includes a housing conforming to the shape of the selected body part. A shear-thickening foam is included in the housing.

6 Claims, 14 Drawing Sheets

(56) References Cited

U.S. PATENT DOCUMENTS

| | | | | |
|---|---|---|---|---|
| 10,244,801 | B2 * | 4/2019 | Witek | A41C 3/12 |
| 2010/0291835 | A1 * | 11/2010 | Omoto | C08G 18/4845 521/170 |
| 2015/0087204 | A1 * | 3/2015 | Conde | A41C 3/142 450/93 |
| 2015/0126631 | A1 * | 5/2015 | Bruno | A42B 3/125 521/54 |
| 2016/0044971 | A1 * | 2/2016 | Randall | A41C 3/142 450/39 |
| 2017/0233519 | A1 * | 8/2017 | Corinti | C08G 18/10 521/159 |
| 2018/0279692 | A1 * | 10/2018 | Witek | A41C 5/00 |
| 2019/0216141 | A1 * | 7/2019 | Witek | D04B 1/246 |
| 2021/0169152 | A1 * | 6/2021 | Choudhury | A41C 3/005 |
| 2024/0000164 | A1 * | 1/2024 | Zhang | A41C 3/12 |

FOREIGN PATENT DOCUMENTS

| | | | |
|---|---|---|---|
| CN | 210017916 | U | 2/2020 |
| CN | 111134409 | A | 5/2020 |
| JP | 2005089925 | A | 4/2005 |
| JP | 2020018624 | A | 2/2020 |
| JP | 2020521891 | A | 7/2020 |
| JP | 2023545561 | A | 10/2023 |

OTHER PUBLICATIONS

Deirdre E Mcghee et al., "Optimising breast support in female patients through correct bra fit. a cross-sectional study."; Journal of Science & Medicine in Sport, 13(6), 568-572. 2010. DOI: 10.1016/j.jsams.2010.03.003.

1st Office Action of corresponding Japan Patent Application No. 2024-542326 mailed on Jul. 15, 2025.

* cited by examiner

SPORTSWEAR AND BODY-PROTECTING GEARS INCORPORATING SHEAR-THICKENING OR NON-NEWTONIAN FOAMS

CROSS-REFERENCES WITH RELATED APPLICATIONS

This application claims priority to U.S. Provisional Patent Application No. 63/308,479 filed Feb. 9, 2022; and U.S. Provisional Patent Application No. 63/355,664 filed Jun. 27, 2022; the disclosures of which are incorporated herein by reference in their entirety.

FIELD OF THE INVENTION

The present invention related to body-supporting or body protecting gears, garments, and undergarments, sportswear and gears, and other special-purpose clothing that incorporate shear-thickening/non-Newtonian foams that exhibit increased resistance when impacted by increased forces from the body of the wearer or from external forces.

BACKGROUND

Shear thickening materials are materials that exhibit a dramatic increase in viscosity in response to a high rate of shear strain—for example, from an impact from an outside force or due to the movement of a body part engaging in a sports activity. Shear-thickening fluids are also termed "non-Newtonian fluids" because they do not follow Newtonian behavior, that is, a viscosity that is independent of the applied stress. Typically, shear thickening materials are formed as a suspension of particles in a matrix.

Shear-thickening materials have been used in many protective articles of clothing and gear, military body armor, and sports gears. However, since shear thickening materials are typically fluids, they are difficult to work with and contain within a suitable housing in order to create wearable articles.

In the case of undergarment, for example, brassieres are worn with direct contact with the wearer's skin. The requirements on the materials for making brassieres should include soft and comfortable feelings on the human skin, light weight and air permeability. Flexible polyurethane foam is a soft porous material with low modulus, low density and has open cell structure, which makes it a good material for making the brassiere cups. Nowadays, flexible polyurethane foam, including high resilience and low resilience foam, is massively used in the production of brassiere cups.

Under sports activities on the other hand, when a wearer is engaged in high impact activities, the breasts are in a "butterfly" motion, i.e., moving up and down separately. The "butterfly" motion not only causes pain but can also be harmful to the breast tissue. Therefore, the breast support is crucial in sports bra designs. Typical sports bra cups are divided into three categories: encapsulation, compression, and combination. Researches suggested that women should wear sports bras with different support levels as needed for different activities. The inclusion of thick foam pads inside the bra cups to elevate and compress the breasts in an encapsulation sports bra to reduce vertical breast displacement and exercise-induced discomfort was also proposed.

Commercially available forms such as the flexible polyurethane foam may provide the soft on-skin sensation performance, but lacks sufficient supporting needed for the high intensity body movements during sports activities. Thus, flexible polyurethane may be acceptable for making casual wearing brassiere cups, but not for sports bra cups that aim to eliminate breast movements. The soft on-skin sensation characteristic exhibited by a cushion material usually means the material has low modulus, which is in contradictory to high supporting characteristic, which usually arises from high modulus of the cushion material. To the inventors' knowledge, there exists no foam material for brassieres that can produce a bra cup that exhibits the combined characteristic of soft on-skin sensation and sufficient supporting needed for high intensity body movements.

U.S. Patent Application Publication No. 2015/0087204 describes a garment including a shape memory material, wherein upon the shape memory material reaching a transition temperature, the shape memory material transforms from a first shape to a second shape, wherein the second shape imparts a greater force to a body part with which the garment is in contact as compared to the force imparted to the body part by the first shape, wherein the transition temperature is between, and including, 90° F. and 105° F. The disclosed shape memory materials include shape memory alloy and shape memory polymer, wherein upon the shape memory material reaching a transition temperature, the shape memory material transforms from a first shape to a second shape and the second shape imparts a greater localized supportive force to a body part with which the garment is in contact as compared to the force imparted to the body part by the first shape. However, in the commercialized sports bra, the bra cup is composed of laminated or seamed multi-layer structures. Its shape is pre-fixed and is not changed whether at room temperature or body temperature. The change from the second shape to the first shape is hardly realized in commercial bra products.

China Patent Application Publication No. CN103798978A discloses a shape memory polymer bra, which includes a cup and an accessory, and is characterized in that the cup is made of a shape memory polymer material and is formed by forming a sheet and then blistering into a cup or injection molding with the softening point 45-70° C. Shape memory polymer is foamed or non-foamed material. The shape memory polymer can be cross-linked trans polyisoprene, polyester or polyolefin, or non-crosslinked polyurethane or norbornene. The cup has a vent hole with a diameter of 1~3 mm, and the total area of the vent hole accounts for 10~70% of the total area of the shape memory polymer. By heating to a softening point of 45 to 70° C., it is reshaped into a breast size suitable for the user, improving comfort. The invention is to change the cup size by using shape memory function of shape memory foam with the softening temperature much higher than body temperature such as 50-60° C. However, the shaping of the bra requires a mold to achieve permanent deformation. Moreover, the softening temperature is much higher than the body temperature. The shape change must be triggered by external heating. The need for insufficient supporting function is not met from this disclosed sports bra materials.

Furthermore, in U.S. Patent Application Publication No. 2016/0044971, a brassiere incorporating a shape memory polymer and a method for manufacturing the same are disclosed. The shape memory polymer is used to provide a thin film layer (opening rate: 10-90%) with holes. The breast's motion frequency absorbs the force caused by breast motion at 1~100 Hz. A method for constructing a sports bra front panel with a thermally-induced shape memory polymer that exhibits viscoelastic properties when at body temperature and stiffens to absorb between about 0.015N and about 0.03N of force at frequencies of breast movement of between about 6 Hz and about 15 Hz is also disclosed. However, the film directly used in bra can now provide sufficient comfort sense to the wearers. Although the mesh pattern of the SMP layer in a laminated structure is used to enhance the breath-ability, the extra molding is needed to form the concave shape that approximates a shape of the wearer's breasts. In the commercial bra cup, foam materials laminated with fabric provide the best comfort sensation instead of porous film. The disclose thin film with holes is incompatible with the commercial bra cup materials system.

Japan Patent Application Publication No. JP2005089925A discloses a cup portion comprising a cup support member made of a shape memory resin that is restored to an initial shape at a constant temperature. The constant temperature is a glass transition temperature $T_g$ and is in a range of 40 to 75° C. Although the cup portion is deformed by washing, it is easy to return to its original shape, and can keep a beautiful bust line silhouette at the constant temperature. However, in the real life, extra heating to change the cup shape is not convenient for the wearers in daily life. Moreover, the different shape in bra cannot resolve the problem arising from insufficient support of sports bra.

U.S. Pat. No. 7,731,564B2 presents a use of a memory foam insert in bras, camisoles, shorts, and briefs. The memory foam insert is designed to limit and prevent the bouncing motion through the breast and gluteal area during rigorous athletic activity. The invention conforms and molds itself to the individual's shape and figure, thereby allowing for a comfortable and secure fit. However, in sport bra, vigorous movement may cause the instability of insert foam or the overlock/cover stitch may be needed throughout the garment to bind together the elements, which may deteriorate the overall seamless circular knitting design in bra cup.

Lastly, China Patent No. CN2378955Y discloses a utility model that provides a pair of brassieres with a shape memory ability. The utility model is characterized in that a liner comprises silk screens which are made from NiTi shape memory alloy or other super elastic alloy, are coated by silica gel or other elastic polymer materials, and are provided with a plurality of ventilation holes. The lining is made from various woven fabrics and non-woven fabrics. The brassieres or underwear with the brassieres are made by taking leather as face masks. Although the brassieres have the advantages of beautiful appearance, stabilization, softness, elasticity, good ventilation property, good bio-compatibility and vivid hand feeling, the use of the exotic metal alloy in their constructions means a complex manufacturing process and expensive material cost. The presence of metal can also be dangerous for the wearer under high intensity activities.

Therefore, there is an unmet need in the art for improved body-protective gears, garments, and undergarments, sportswear and gears, and other special-purpose clothing that incorporated improved shear-thickening materials that address the aforementioned shortcomings.

SUMMARY OF THE INVENTION

In accordance to a first aspect of the present invention, a sports bra exhibiting increased resistance in response to increased force is provided. The sports bra includes a front curved region for accommodating a wearer's breasts, the front curved region including a shear-thickening foam. The shear-thickening foam is relatively flexible up to a first force and is relatively rigid above the first force to retain the wearer's breasts within the front curved region during vigorous physical activity. A back panel connecting to the front curved region such that the force is at least partially transferred to an upper back or shoulder region of the wearer.

In accordance to a second aspect of the present invention, an auto fitting and supporting foam, which can be used in body-protective gears, garments, and undergarments, sportswear and gears, including sports bras, and other special-purpose clothing, is provided. The foam has a glass transition temperature in the range of 30~50° C. and a tangent delta value above 0.5 in the range of 30~50° C., which is around body temperature determined by Dynamic Mechanical Analysis (DMA) testing. The high damping property at around body temperature means it can absorb the vibration energy and effectively eliminate the vibration during high frequency movement. The form has a density of 30~100 $kg/m^3$, and can be easily deformed under slow or static compression from wearer's body. Further, the foam is frequency sensitive. It possesses low modulus under low frequency motion and becomes stiff under high frequency movement at body temperature. Therefore, the foam is able to provide sufficient supporting force for breast under vigorous body movements, meanwhile easily deformed to fit the wearer's body profile under static pressure.

In accordance to a third aspect of the present invention, a body protecting element for protecting a body part from an external impact is provided. The body part may be the head, knee, shin, elbow, foot, leg, torso, arm, wrist, or hand, The body protecting element includes a housing conforming to the shape of the selected body part. A shear-thickening foam is included in the housing.

BRIEF DESCRIPTION OF THE DRAWINGS

Embodiments of the invention are described in more details hereinafter with reference to the drawings, in which.

DETAILED DESCRIPTION

In the following description, body-protective gears, garments, and undergarments, sportswear and gears, other special-purpose clothing, and materials for making the same are set forth as preferred examples. It will be apparent to those skilled in the art that modifications, including additions and/or substitutions may be made without departing from the scope and spirit of the invention. Specific details may be omitted so as not to obscure the invention; however, the disclosure is written to enable one skilled in the art to practice the teachings herein without undue experimentation.

A. Design of a Sports Bra

Figure 1:
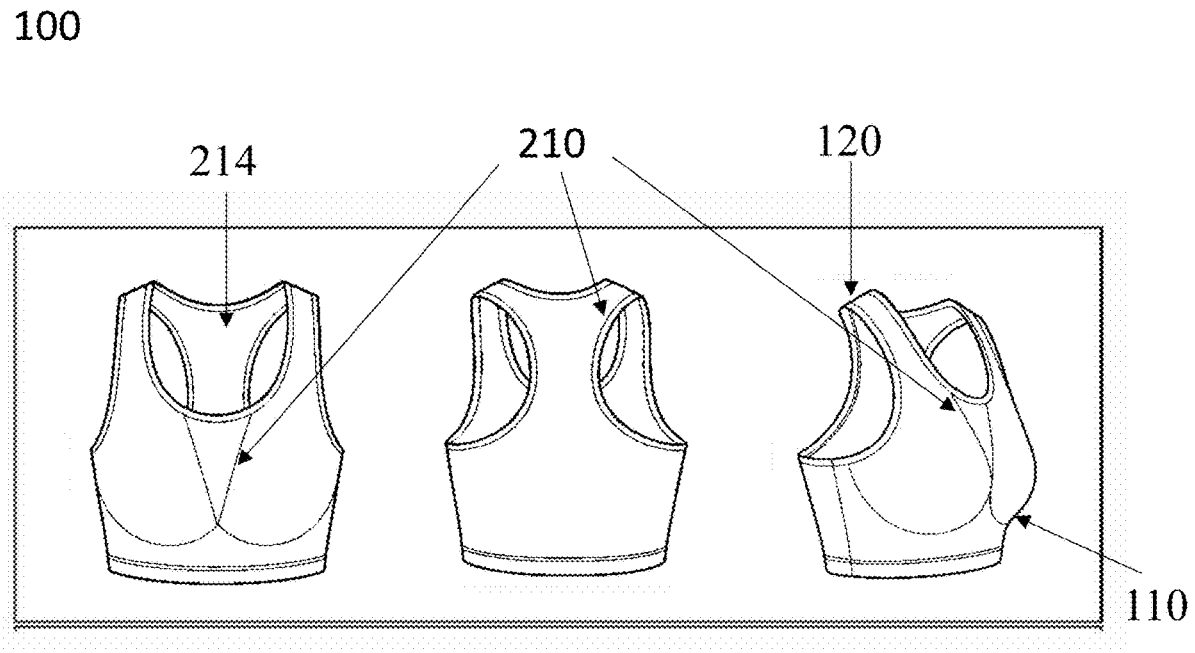
FIG. 1 illustrates a sports bra according to one embodiment of the present invention.

Turning to the drawings in detail. FIG. 1 depicts a sports bra (100) according to an embodiment of the present invention. As shown in FIG. 1, with the indicated regions indicating the support elements or regions (210) for a sports bra (100), the support regions (210) encircle the breast and then continue on to a back support (214) in order to transfer the forces to the upper back and shoulder regions (120). The support regions (210) include the non-Newtonian foams described in further detail below. In general, the non-Newtonian foams are soft and flexible, having a modulus of less than $10^5$ Pa at low frequency movement (<10 Hz) and its modulus increases (>$10^5$ Pa) when the frequency or force of movement increases (>10 Hz). In this manner, during non-vigorous activity, the sports bra (100) is soft, flexible, and comfortable to wear. When performing vigorous sports activity, such as running, tennis, jumping rope, etc., motion of the breasts creates a greater force on the foam that also increases the modulus to above $10^5$ Pa. This increased modulus resists unwanted breast motion and maintains the breasts in a front curved breast-retaining panel (110). Note that the sports bras of the present invention may include cup-shaped inserts for additional support that may or may not include the non-Newtonian foams of the present invention. Alternatively, the non-Newtonian foams encircling the breasts as shown in FIG. 1 may provide sufficient support on its own, acting in manner similar to an underwire support but without the rigid discomfort of an underwire.

Figure 2:
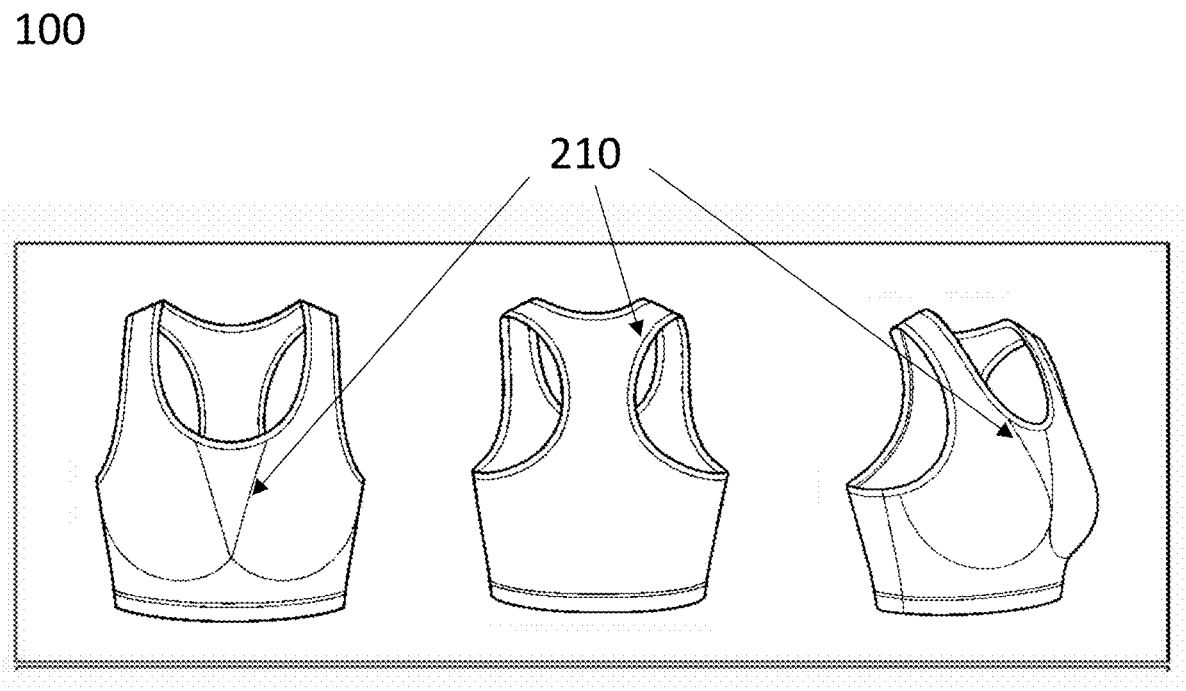
FIG. 2 illustrates a sports bra according to a further embodiment.

Similarly, the configuration of the support elements (210) as shown in FIG. 2 can mimic the support provided by a conventional underwire. The foam in this embodiment resists breast movement at high forces.

Figure 3:
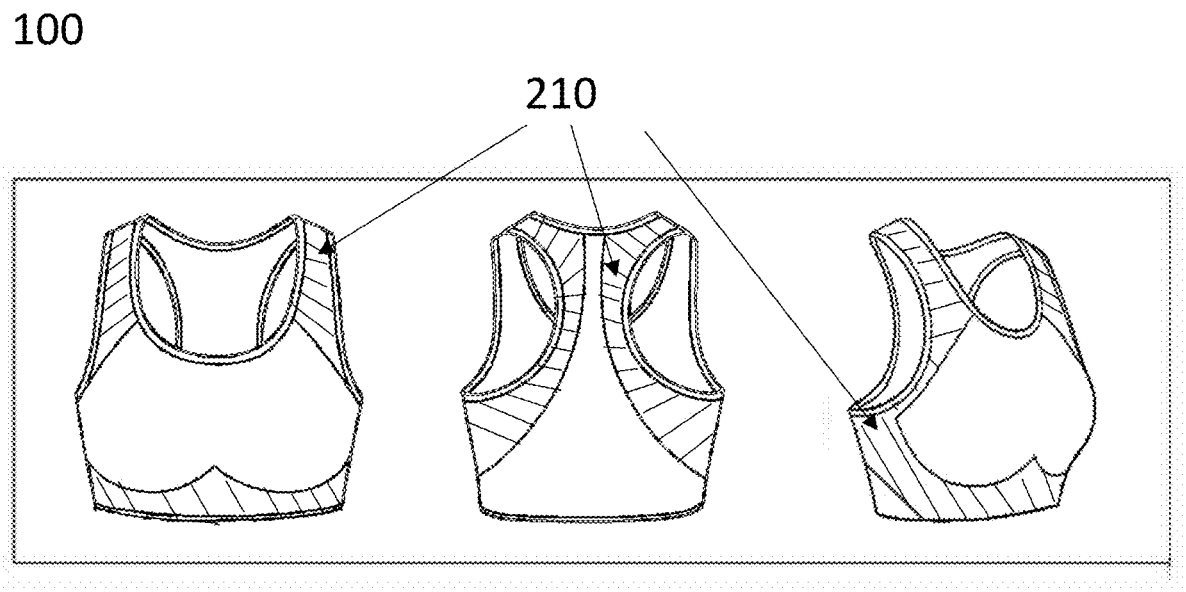
FIG. 3 illustrates a sports bra according to a further embodiment.

FIG. 3 indicates the support elements (210), shows a further embodiment that provides a greater area of supporting non-Newtonian foam and connects through side panels (212) to the back support straps (214) in order to transfer the forces to the upper back and shoulder region.

Figure 4:
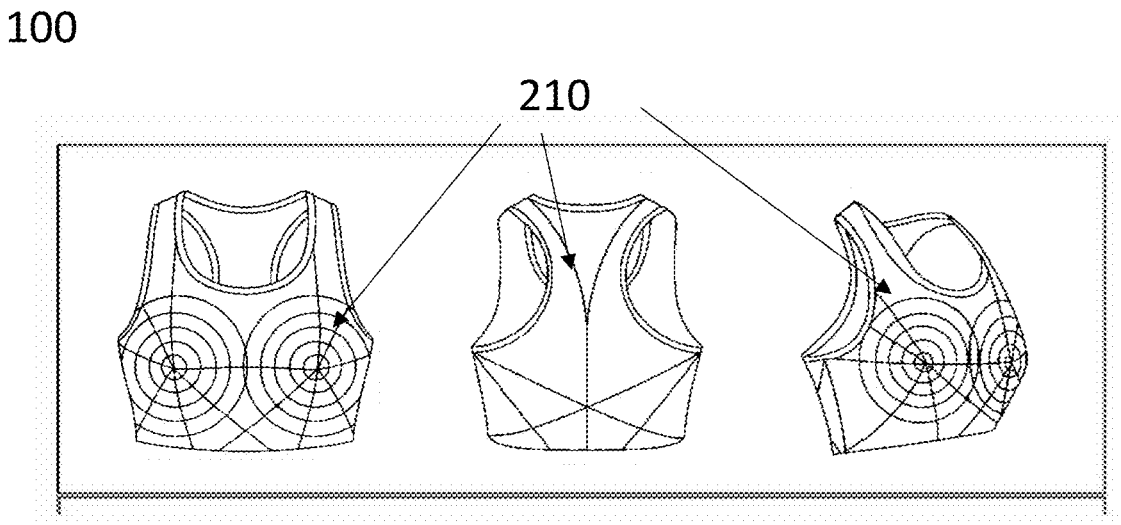
FIG. 4 illustrates a sports bra according to a further embodiment.

FIG. 4 indicates the support elements (210), shows a further embodiment that provides a pattern of supporting foam in concentric patterns surrounding the entire front portion (110) of the breast and interconnecting with the back support (214). This configuration may provide additional support for fuller breasts.

Figure 5:
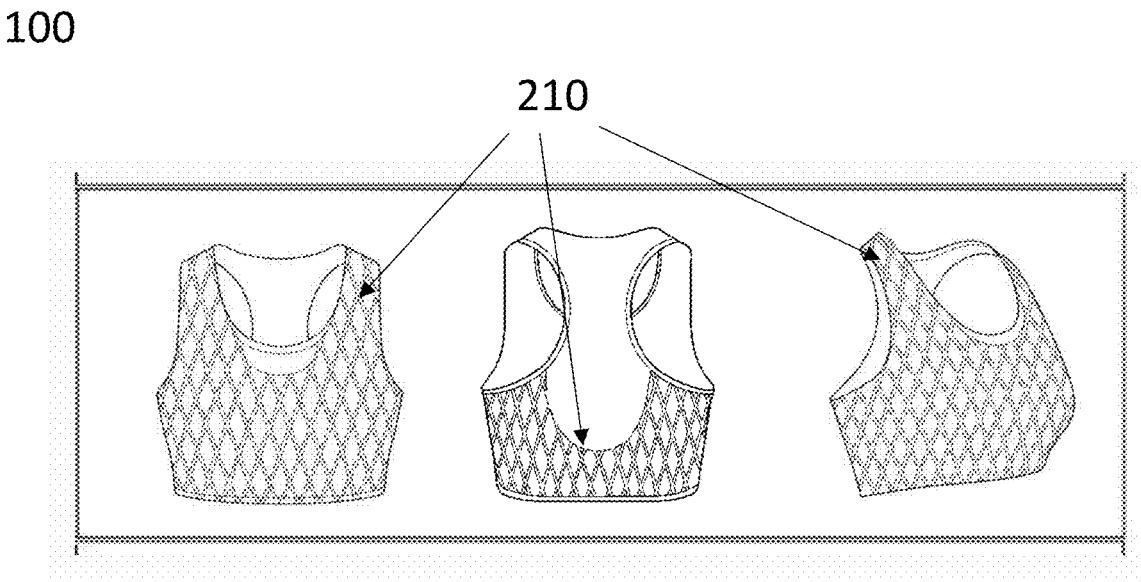
FIG. 5 illustrates a sports bra according to a further embodiment.

FIG. 5 indicates the support elements (210), shows a further embodiment that provides another pattern providing stronger support for fuller-breasted individuals. A mesh-pattern of foam covers the entire front and side of the breast and continues on the back support (214) for load transfer.

Figure 6:
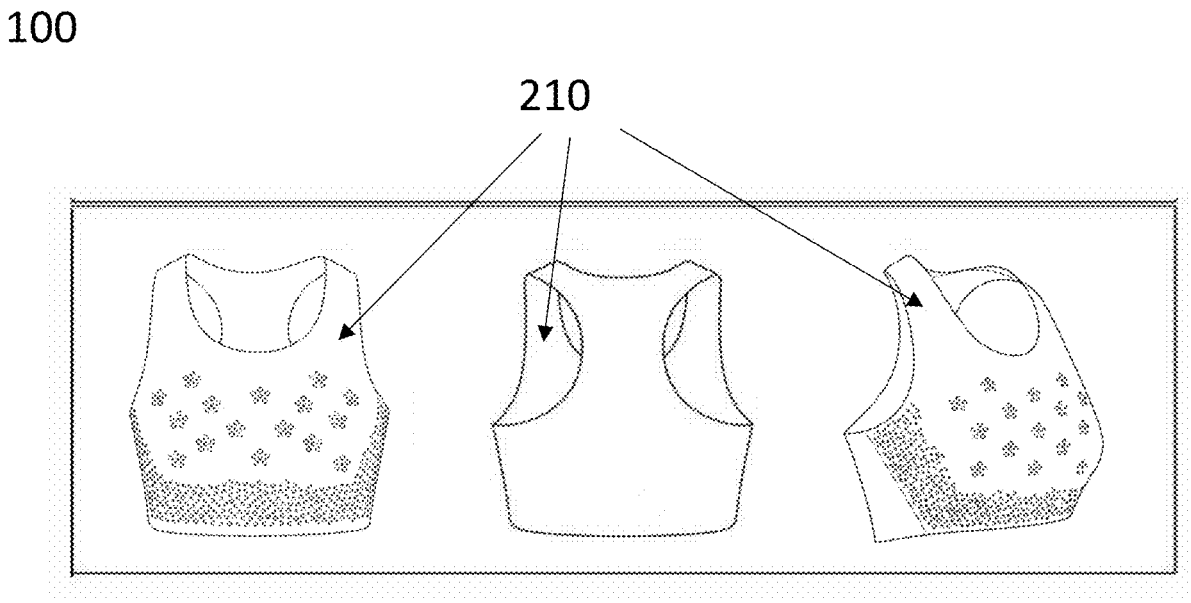
FIG. 6 illustrates a sports bra according to a further embodiment.

FIG. 6 indicates the support elements (210), shows a further embodiment for full-breasted wearers that includes most of the front region (110) of the breast supported by the non-Newtonian foam.

Figure 7:
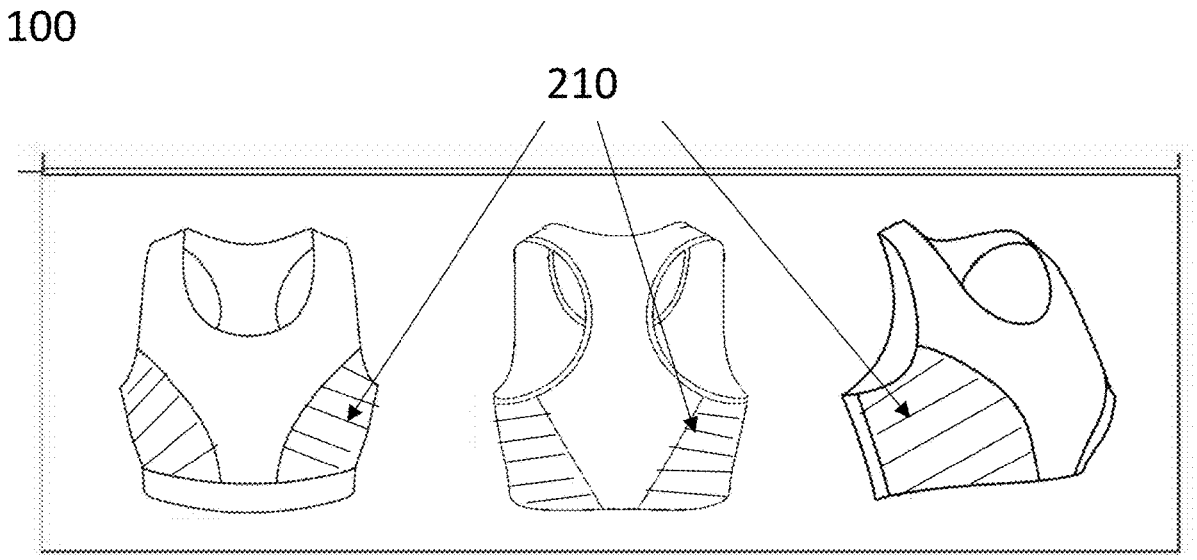
FIG. 7 illustrates a sports bra according to a further embodiment.

FIG. 7 indicates the support elements (210), shows a further embodiment that provides greater side support for the breasts with non-Newtonian foam positioned at the side and around to the back support region (214).

The supporting foam may be incorporated into sports bras through a variety of techniques; because there is no liquid matrix as in prior art shear-thickening fluids various commercially-scalable processes may be used in construction. For example, without limitation, the support regions may be formed by extrusion, injection molding, die cutting, molding, hot pressing, 3D-printing, cutting and sewing, or seamless bonding techniques.

B. Auto Fitting and Supporting Foams

In accordance to a second aspect of the present invention, an auto fitting and supporting foam, which can be shear-thickening or non-Newtonian foam, is provided. The auto fitting and supporting can be used in body-protective gears, garments, and undergarments, sportswear and gears, including sports bras, and other special-purpose clothing.

Figure 8:
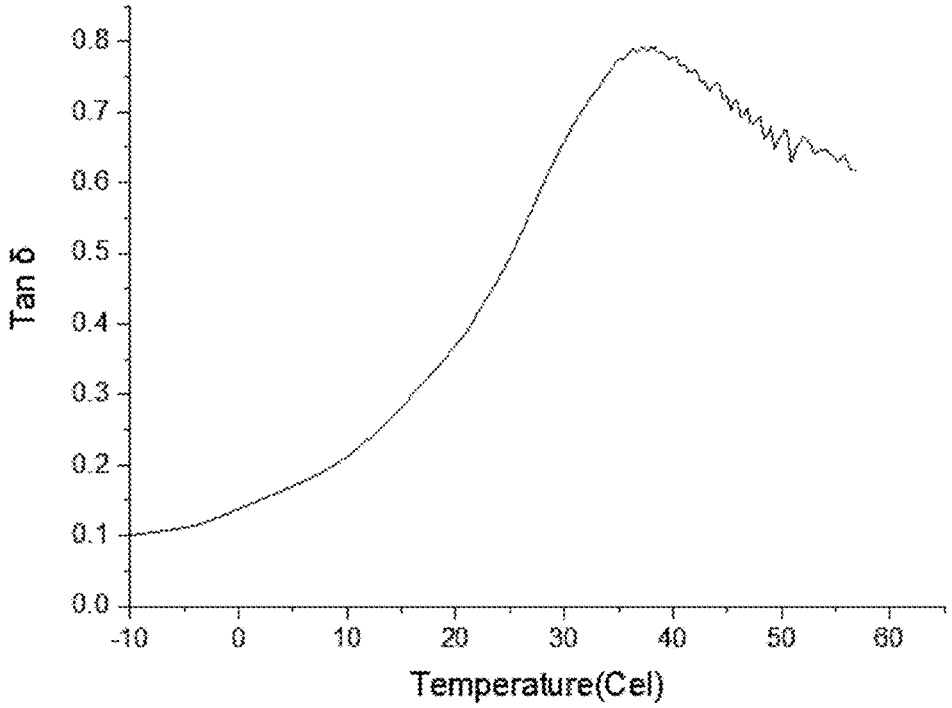
FIG. 8 shows the DMA test results of tangent delta (tan δ) versus temperature of an auto fitting and supporting foam according to one embodiment of the present invention.

Referring to FIG. 8, which shows the DMA test results of tangent delta (tan δ) versus temperature of the auto fitting and supporting foam. The test was conducted under compression mode. The frequency is 1 Hz, and the heating rate is 3° C./min. As shown in FIG. 8, the foam has a glass transition temperature from 30 to 50° C., which is near body temperature. The tangent delta (tan δ) in the range of 30~50° C. is above 0.5. The high tan δ value means that the foam has high damping property at around body temperature which means it can absorb the vibration energy and stop the vibration during high frequency movement.

Figure 9:
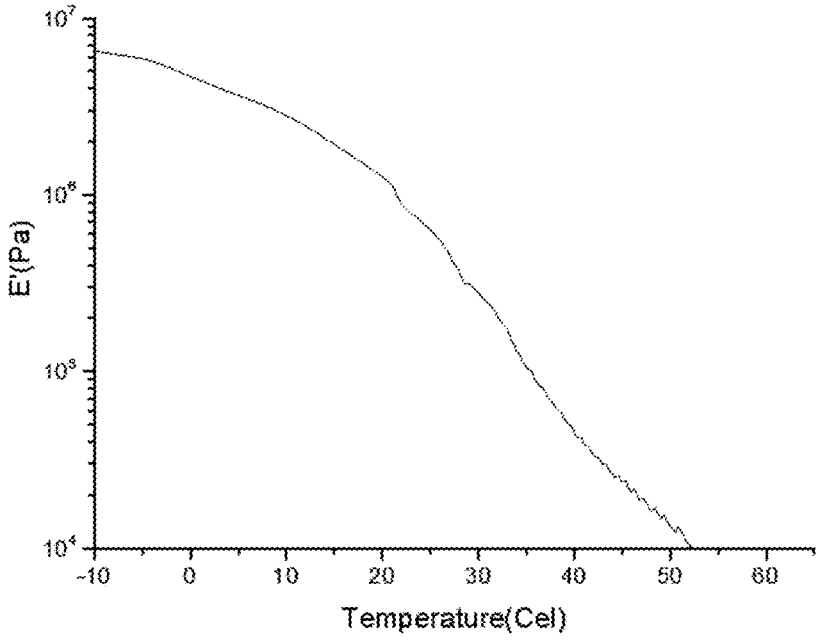
FIG. 9 shows the DMA test results of storage modulus (E') versus temperature of the auto fitting and supporting foam.

Referring to FIG. 9, which shows the DMA test results of storage modulus (E') versus temperature of the auto fitting and supporting foam. The test was conducted under compression mode. The frequency is 1 Hz, and the heating rate is 3° C./min. As shown in FIG. 9, the foam is temperature sensitive. The compression modulus change of the foam is about one order of magnitude between 25° C. and 36° C., i.e., it is $6\times10^5$ Pa at 25° C. and $8\times10^4$ Pa at 36° C. determined by DMA measurement at 1 Hz. The E'(25° C.)/E'(36° C.)=7.5.

Figure 10:
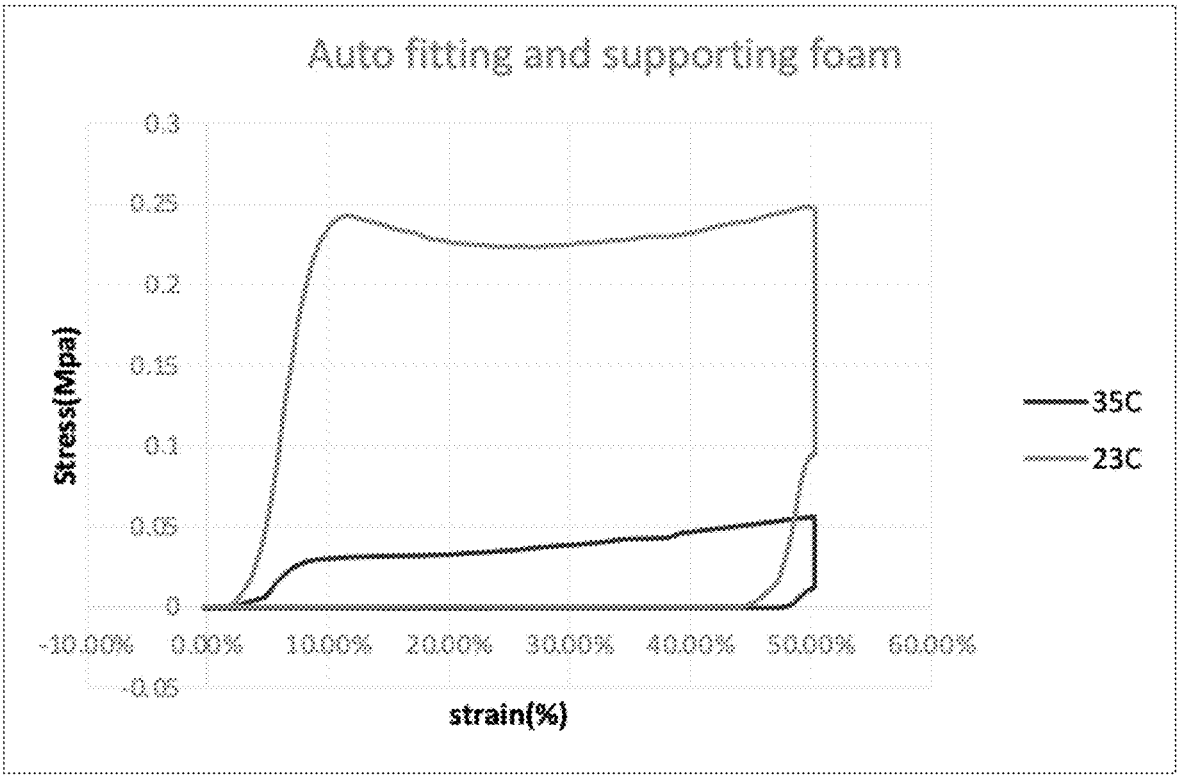
FIG. 10 shows the results of a compression test on the auto fitting and supporting foam under different temperatures.

Referring to FIG. 10, which shows the results of a compression test on the auto fitting and supporting foam under different temperatures at 23° C. (darker line) and 35° C. (lighter line) respectively. The max compression ratio was 50%. Under the compression test using a universal tensile testing machine, the foam shows a similar trend to that tested by DMA. The compression stress(S) at 50% strain at 23° C. is about 0.25 MPa whereas it is about 0.05 MPa at 35° C. The S (23° C.)/S (35° C.)=5.

Figure 11:
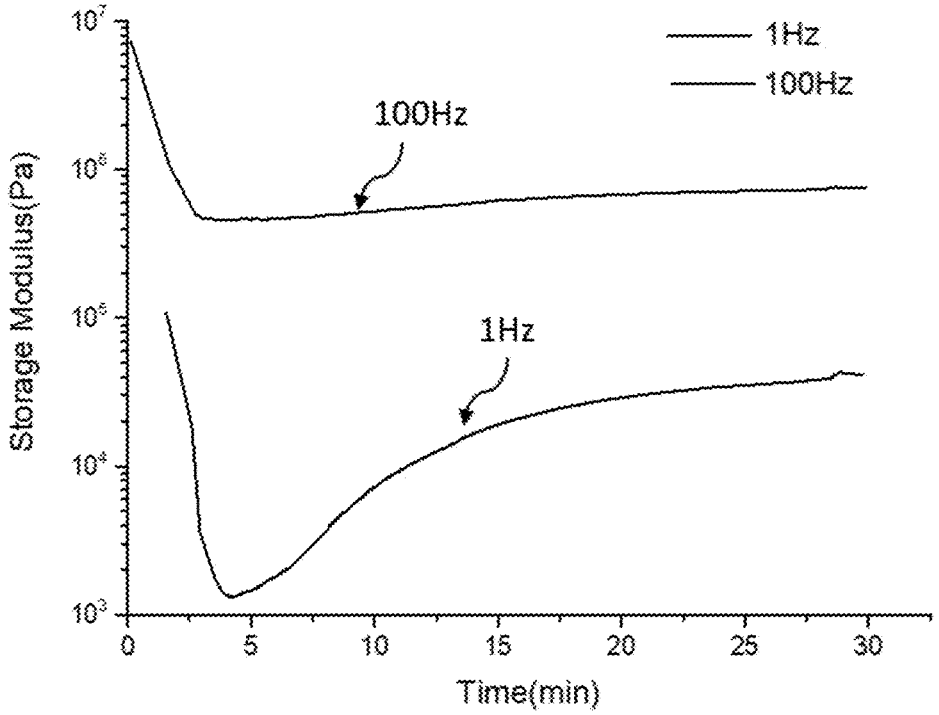
FIG. 11 shows the modulus of the auto fitting and supporting foam at 1 Hz and 100 Hz at 25° C. tested by DMA measurement.

In addition to temperature sensitive, the foam is also frequency sensitive. Referring to FIG. 11, which shows the modulus of the auto fitting and supporting foam at 1 Hz and 100 Hz at 25° C. tested by DMA measurement. The measurement was conducted under isothermal temperature 25° C., and the testing duration was 30 min. The foam was tested in compression mode by DMA in the isothermal condition at 25° C. Two frequency value, 1 Hz and 100 Hz, is used respectively. The testing is conducted for 30 minutes under these conditions. At 25° C. the modulus is about $7.5\times10^5$ Pa at 100 Hz whereas it is $4\times10^4$ Pa at 1 Hz. The E'(100 Hz)/E'(1 Hz)=18.8 at 25° C.

Figure 12:
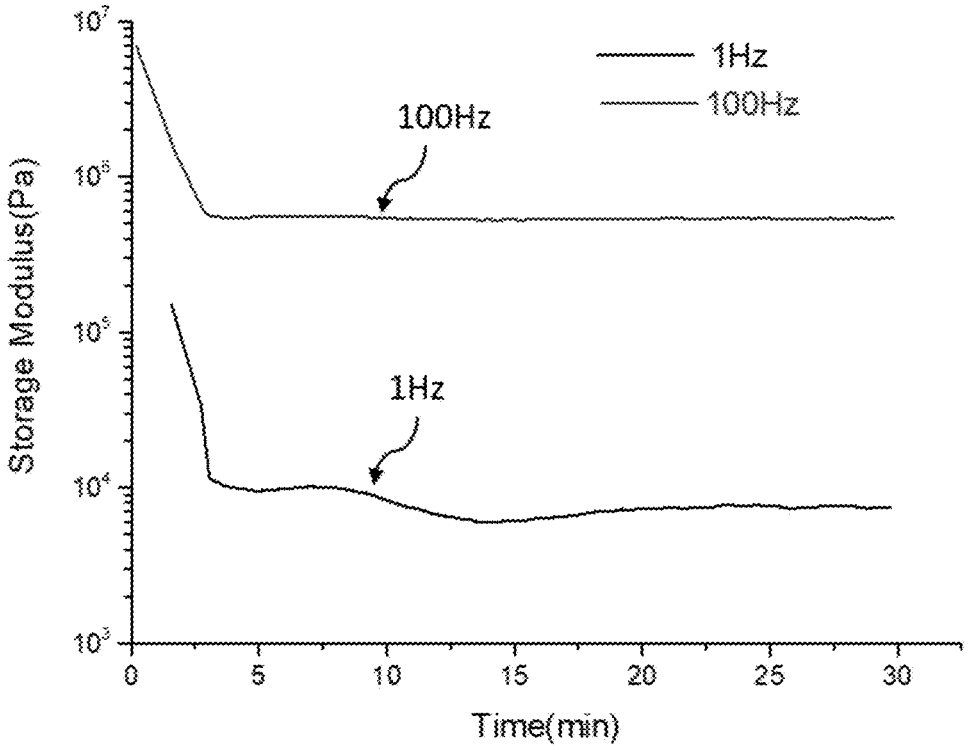
FIG. 12 shows the modulus of the auto fitting and supporting foam at 1 Hz and 100 Hz at 35° C. tested by DMA measurement.

Referring to FIG. 12, the foam was also tested at 35° C. under the same conditions. The modulus is about $5\times10^5$ Pa at 100 Hz and it is $8\times10^3$ Pa at 1 Hz at 35° C. The E'(100 Hz)/E'(1 Hz)=62.5 at 35° C. The E'(100 Hz)/E'(1 Hz) value at 35° C. is much bigger than that at 25° C. since the glass transition temperature of the foam is closer to the body temperature. Thus, the foam has excellent frequency sensitive at body temperature, i.e., it has low modulus at low frequency movement and high modulus at high frequency movement at body temperature.

When the foam is a polyurethane foam, it may contain the following components: 100 parts polyether mixture, 0.5~5 parts of water as foaming agent, 0.2~2 parts of foam stabilizer, 0.2~2 parts of cell opening agent, 0.1~1 parts of catalyst mixture, 30~75 parts of diisocyanates. The R value calculated from the mole of isocyanate groups to the mole of total hydroxyl groups is in the range between 0.9 and 1.1. The polyether mixture includes polyether with three and/or two functionalities and the molecular weight is in the range between 500 and 8,000. The diisocyanate is composed of tolylene diisocyanate, methylene diphenyl diisocyanate, the isomer of an isocyanates and its mixture.

The glass transition temperature may be in the range of 30~50° C. and the tangent delta value is above 0.5 from 30 to 50° C. determined under 1 Hz by DMA testing. Further the modulus may decrease with the increasing the temperature from 20 to 50° C.

Other types of foams may be used in various embodiments of the present invention. One such example, without limitation, is an energy absorbing foam material, which is in a non-impact resistant configuration in a long force-application time, and in an impact resistant configuration in a short force-application time. The long force-application time is approximately from 0.1 second to 1,000 seconds, and the short force-application time is approximately below 0.1 second. Under the short force-application time, the elastic modulus of the energy absorbing foam material is approximately 10 times than that under the long force-application time, indicating the energy absorbing foam material is suitable to offer a degree of impact protection. The transition from low elastic modulus (non-impact configuration) to high elastic modulus (impact configuration) is rapid without time delay. In one embodiment, the energy absorbing foam material is flexible and resilient to various kinds of loading, for example, but not limited to, compression, tension, shear, and torsion. Further, it has the ability to adapt the geometry figures/shapes of what it is designed and maintain intimate contact to the protected subject. This is very crucial for being as a protecting material because the induced damage is related to the maximum force resulting from the impact divided by the area over which the force is applied. The energy absorbing foam material in the present invention is able to absorb the impact energy and reduce the force in the area where the force is applied, therefore the stress and pressure of the impact is significantly decreased.

The foam material may comprise at least one shape memory polymer foam and additives. The shape memory polymer foam, for example, but not limited to polyurethane foam, polystyrene foam, silicone rubber foam, polyvinyl chloride foam, ethylene-vinyl acetate foam, polyester block co-polymer foam, and various combinations thereof. Further, the amount of shape memory polymer foam is at least approximately 50 with respect to the weight thereof. The additives, for example, but not limited to anti-oxidant, flame retardant, inorganic fillers and the amounts of additives is less than approximately 50% with respect to the weight thereof.

The foam material provided in the various embodiments of the present invention is in a closed cell foam or an open cell foam. The cell includes, for example, but not limited to gas, vapor or blowing agents. The gas for example, is nitrogen or carbon dioxide. Usually, the gas or vapor would disperse uniformly in the material or non-uniformly according the applications in some embodiments. The presence of gas or vapor within the foam material not only reduces the overall density of the foam material but also provide cushion in the foam material due to the pneumatic effect. These pneumatic damping is crucial for energy absorption and dissipation when the impact suddenly occurs.

The elastic modulus of the energy absorbing foam material in the present invention is influenced by factors, for example, but not limit to temperature, force-application time, loading, or frequency. The elastic modulus of the energy absorbing foam material at the force-application time approximately 0.005 to 0.01 seconds (i.e., with the frequency approximately from 100 to 200 Hz) is approximately 10 times larger than that at the force-application time approximately 1 to 10 seconds (i.e., with the frequency approximately from 0.1 to 1 Hz) at 35° C. Further, the difference of elastic modulus increases to approximately 100 times at the temperature over 45° C.

The glass transition temperature of the energy absorbing foam material is equal to or lower than the application temperature at the force-application time approximately 0.1 to 1 seconds (i.e., with the frequency approximately from 1 to 10 Hz), which indicates the foam material is in rubbery state and behaves soft and flexible. Furthermore, the glass transition temperature of the energy absorbing foam material is higher than the application temperature at the force-application time approximately 0.01 to 0.001 seconds (i.e., with the frequency approximately from 100 to 1,000 Hz), which indicates the foam material is in glassy state and behaves hard and rigid. The yield point of the foam material is approximately from 0.5 kPa to 1 MPa. Meanwhile the yield stress is approximately from 0.5 kPa to 1 MPa. Once the yield point is passed, some deformation will be easily made.

C. Body-Protecting Elements Incorporating Non-Newtonian Foams

In a third aspect, the auto fitting and supporting foams of the various embodiments of the present invention can be applied to body-protecting equipment. This equipment may include, but is not limited to, shin guards, ankle guards, wrist protectors, knee pads, leg shields, torso shields, gloves, shoulder pads, helmets, and footwear. In each of these embodiments, the auto fitting and supporting foams can be readily applied inside a body-conforming housing to create a flexible wearable shield that permits the free motion of the user but fully protects against impacts from objects, persons, or the wearer (e.g., due to falls or impact with inanimate objects).

Figure 13:
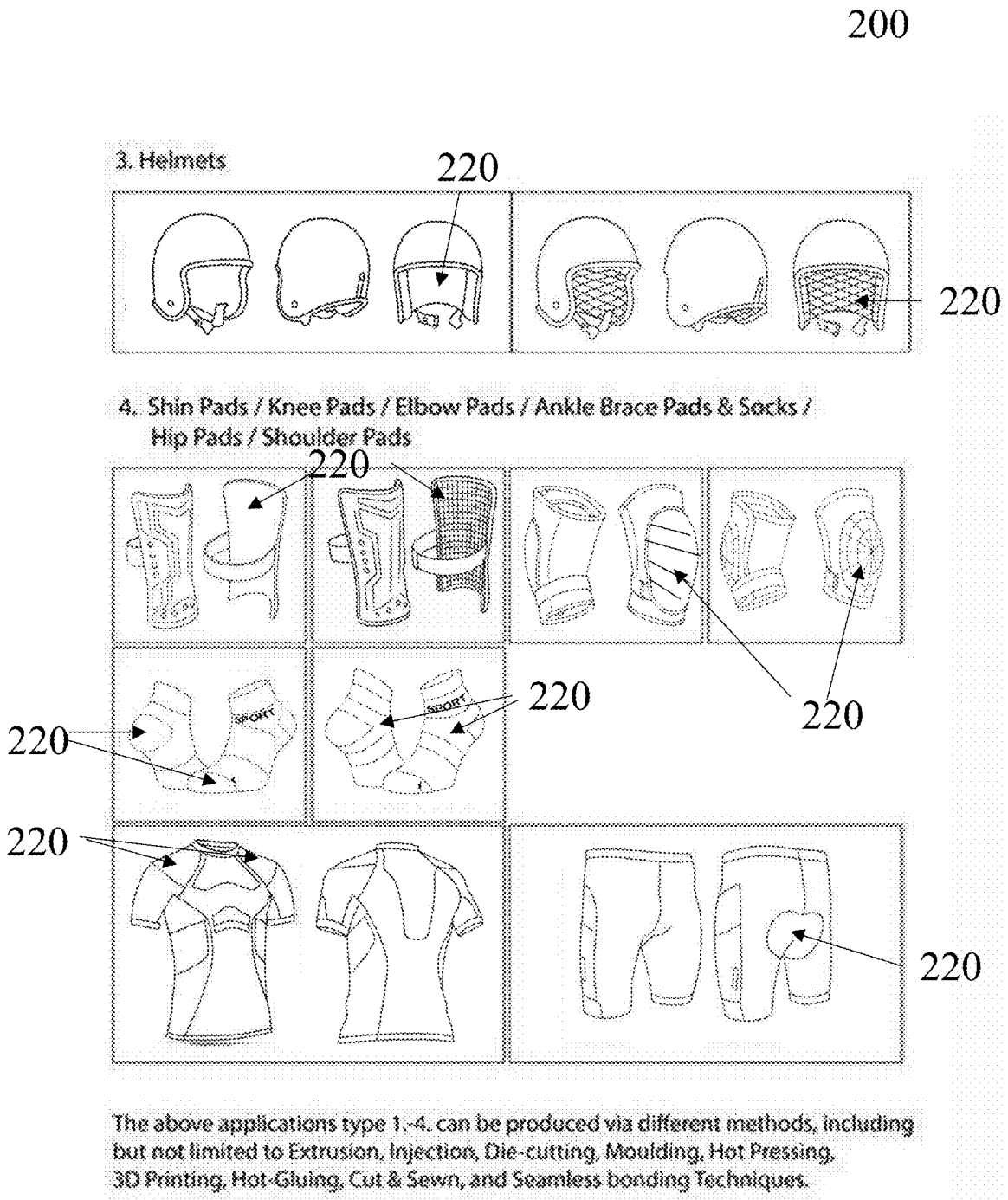
FIG. 13 illustrates various body-protecting garments and gears that incorporate the auto fitting and supporting foams.
Figure 14:
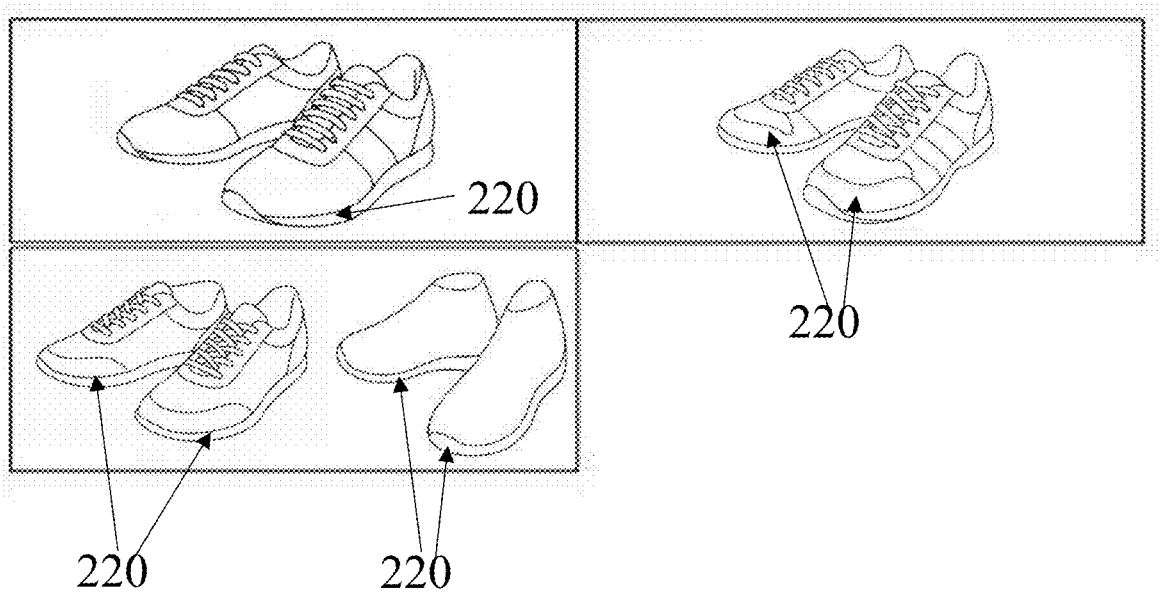
FIG. 14 illustrates various footwear that incorporate the auto fitting and supporting foams.

FIG. 13 indicates the protective elements (220), illustrates various body-protecting garments and gears (200) incorporating the auto fitting and supporting foams. The specific protective elements (220) include shoulder, neck arm, leg, knee, wrist, torso protectors that have a body-conforming shape as the shell and the interior portion is filled with the auto fitting and supporting foams. FIG. 14 indicates the protective elements (220), illustrates various footwear that incorporate the auto fitting and supporting foams. The auto fitting and supporting foam may be incorporated into the body-protecting garments and gears (200) and footwear through a variety of techniques. For example, without limitation, the protective elements may be formed by extrusion, injection molding, die cutting, molding, hot pressing, 3D-printing, cutting and sewing, or seamless bonding techniques.

Throughout this specification, unless the context requires otherwise, the word "comprise" or variations such as "comprises" or "comprising", will be understood to imply the inclusion of a stated integer or group of integers but not the exclusion of any other integer or group of integers. It is also noted that in this disclosure and particularly in the claims and/or paragraphs, terms such as "comprises", "comprised", "comprising" and the like can have the meaning attributed to it; e.g., they allow for elements not explicitly recited, but exclude elements that are found in the prior art or that affect a basic or novel characteristic of the present invention.

Furthermore, throughout the specification and claims, unless the context requires otherwise, the word "include" or variations such as "includes" or "including", will be understood to imply the inclusion of a stated integer or group of integers but not the exclusion of any other integer or group of integers.

References in the specification to "one embodiment", "an embodiment", "an example embodiment", etc., indicate that the embodiment described can include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

It will be appreciated by those skilled in the art, in view of these teachings, that alternative embodiments may be implemented without deviating from the spirit or scope of the invention, as set forth in the appended claims. This invention is to be limited only by the following claims, which include all such embodiments and modifications when viewed in conjunction with the above specification and accompanying drawings.

What is claimed is:

1. A sports bra configured to exhibit increased resistance in response to increased force, wherein the sports bra comprises:

a front curved region for accommodating a wearer's breasts, the front curved region including a shear-thickening foam, wherein the shear-thickening foam is relatively flexible up to a first force and is relatively rigid above the first force to retain the wearer's breasts within the front curved region;

a back panel connecting to the front curved region such that the force is at least partially transferred to an upper back or shoulder region of the wearer, wherein the shear-thickening foam has a glass transition temperature in a range of 30° C. to 50° C., and wherein the shear-thickening foam has a modulus of less than $10^5$ Pa when subjected to a movement frequency of less than 10 Hz, and the modulus increases to more than $10^5$ Pa when the frequency or force of movement increases to more than 10 Hz.

2. The sports bra according to claim 1, wherein the shear-thickening foam comprises one or more of: a polyurethane-based foam, polystyrene foam, silicone rubber foam, polyvinyl chloride foam, ethylene-vinyl acetate foam, and polyester block co-polymer foam.

3. The sports bra according to claim 2, wherein the shear-thickening foam is a polyurethane foam comprising: 100 parts polyethers mixture, 0.5-5 parts of water as foaming agent, 0.2-2 parts of foam stabilizer, 0.2-2 parts of cell opening agent, 0.1-1 parts of catalyst mixture, 30-75 parts of diisocyanates; wherein the R value calculated from the mole of isocyanate groups to the mole of total hydroxyl groups is in the range between 0.9 and 1.1.

4. The sports bra according to claim 1, wherein the shear-thickening foam exhibits a tangent delta value above 0.5 from 30° C. to 50° C., as determined by DMA testing at a frequency of 1 Hz.

5. The sports bra according to claim 1, wherein the modulus decreases when the temperature increases from 20° C. to 50° C.

6. The sports bra according to claim 1, wherein the shear-thickening foam is distributed in a concentric pattern surrounding at least one breast-covering portion of the front curved region.

* * * * *